US005449168A

United States Patent [19]

Olexy et al.

[11] Patent Number: 5,449,168

[45] Date of Patent: Sep. 12, 1995

[54] SORTING APPARATUS AND SORTING AND PROCESSING APPARATUS

[75] Inventors: Anthony M. Olexy, Honeoye Falls; Michael P. Urbon, Churchville; Paul D. Westlake, Rochester, all of N.Y.

[73] Assignee: Eastman Kodak Company, Rochester, N.Y.

[21] Appl. No.: 221,435

[22] Filed: Mar. 31, 1994

[51] Int. Cl.[6] ..... B65H 39/10

[52] U.S. Cl. ..... 271/297; 271/299; 271/303

[58] Field of Search ..... 271/184, 273, 274, 213, 271/292, 297, 299, 303, 314

[56] References Cited

U.S. PATENT DOCUMENTS

| | | | |
|---|---|---|---|
| D. 254,975 | 5/1980 | Gambrell et al. . | |
| 3,744,790 | 7/1973 | Hoffman . | |
| 3,913,905 | 10/1975 | Schulze | 271/292 |
| 4,011,952 | 3/1977 | Smith et al. . | |
| 4,095,782 | 6/1978 | Breuers et al. . | |
| 4,141,546 | 2/1979 | Queener . | |
| 4,148,475 | 4/1979 | Schulz . | |
| 4,299,382 | 11/1981 | Ichikawa . | |
| 4,322,069 | 3/1982 | Mitchell . | |
| 4,361,321 | 11/1982 | Holliday . | |
| 4,534,643 | 8/1985 | Watanabe . | |
| 4,640,604 | 2/1987 | Kozuka et al. | 271/292 X |
| 4,734,748 | 3/1988 | Murayama et al. | 271/292 X |
| 4,819,931 | 4/1989 | Goto et al. . | |
| 4,849,790 | 7/1989 | Ito . | |
| 5,104,117 | 4/1992 | McCormick et al. . | |
| 5,204,727 | 4/1993 | Haneda et al. | 271/273 X |

FOREIGN PATENT DOCUMENTS

| | | | |
|---|---|---|---|
| 357055 | 3/1990 | European Pat. Off. | 271/292 |
| 201775 | 9/1987 | Japan | 271/292 |
| 143869 | 6/1991 | Japan | 271/292 |

*Primary Examiner*—David H. Bollinger
*Attorney, Agent, or Firm*—Robert L. Walker

[57] ABSTRACT

A sorting apparatus for use with a processor for media sheets. The processor has a top discharge and a service opening adjoining the discharge. The sorting apparatus has a body mounted on the processing apparatus. The body pivots about an axis of rotation, between closed and open positions. In the closed position, the body blocks access to the service opening. In the open position, the body is displaced from the service opening. The body has an upper surface substantially radial to the axis of rotation. A partition member is mounted on the body. The partition member has a unitary array of parallel partitions extending outward from the body. The partitions define bins for the media sheets. The partition member is movable independent of the body, between an operative position, in which the partitions define a zone of obstruction extending outward from the upper surface of the body; and a displaced position, in which the partitions are at least substantially removed from the zone. A sorter mechanism is disposed substantially within the body. The sorter mechanism has sheet guides that define primary and secondary passages. The primary passage has an entrance aligned with the discharge. The secondary passages each branch individually from the primary passage. The secondary passages each having an exit adjoining a respective bin. The sorter mechanism has a transport system for propelling the media sheets along the primary passage to selected bins. A sorting and processing apparatus includes a processor and the sorting apparatus.

18 Claims, 8 Drawing Sheets

SORTING APPARATUS AND SORTING AND PROCESSING APPARATUS

CROSS-REFERENCE TO RELATED APPLICATION

Related design application Ser. No. DE 29/022,321, entitled "Removable Sorter Bins", by Carole Bilson, was filed concurrently with this application.

FIELD OF THE INVENTION

The invention relates to X-ray film and paper handling equipment. The invention more particularly relates to a sorting and processing apparatus and a sorting apparatus.

BACKGROUND OF THE INVENTION

A wide variety of sorting and processing equipment has long been available for use with copier papers and transparencies, photographic films and papers, and other media sheets.

Most sorting equipment is not tightly constrained as to the time required to clear jams or process an interrupting job. Equipment users would prefer that these procedures be quick and easy; but most users do not mind a minute or two of delay, if the procedures are not otherwise unduly burdensome. This is not true for equipment subject to emergency use, such as x-ray processing equipment, where every second may matter. With such equipment, it is desirable to both have sorting apparatus to handle the sorting of routine matters on a regular basis and to have the option to, in effect, very quickly eliminate the sorting apparatus in the event of an emergency.

There is a further constraint on equipment subject to medical use or the like. Space is very often at a premium in hospitals and other medical facilities, particularly alongside x-ray processing equipment. It is thus desirable to provide equipment that does not require additional clearance to the back, front, or sides during use. X-ray equipment is also likely to need to be repaired quickly.

SUMMARY OF THE INVENTION

The invention, in its broader aspects, provides a sorting apparatus for use with a processor for media sheets. The processor has a top discharge and a service opening adjoining the discharge. The sorting apparatus has a body mounted on the processing apparatus. The body pivots about an axis of rotation, between closed and open positions. In the closed position, the body blocks access to the service opening. In the open position, the body is displaced from the service opening. The body has an upper surface substantially radial to the axis of rotation. A partition member is mounted on the body. The partition member has a unitary array of parallel partitions extending outward from the body. The partitions define bins for the media sheets. The partition member is movable independent of the body, between an operative position, in which the partitions define a zone of obstruction extending outward from the upper surface of the body; and a displaced position, in which the partitions are at least substantially removed from the zone. A sorter mechanism is disposed substantially within the body. The sorter mechanism has sheet guides that define primary and secondary passages. The primary passage has an entrance aligned with the discharge. The secondary passages each branch individually from the primary passage. The secondary passages each having an exit adjoining a respective bin. The sorter mechanism has a transport system for propelling the media sheets along the primary passage to selected bins. The invention also provides a sorting and processing apparatus including a processor and the sorting apparatus of the invention.

It is an advantageous effect of at least some of the embodiments of the invention that compact sorting apparatus are provided in which media sheet jams are very accessible and single sheet use is not compromised.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying figures wherein.

DESCRIPTION OF PARTICULAR EMBODIMENTS

Figure 1:
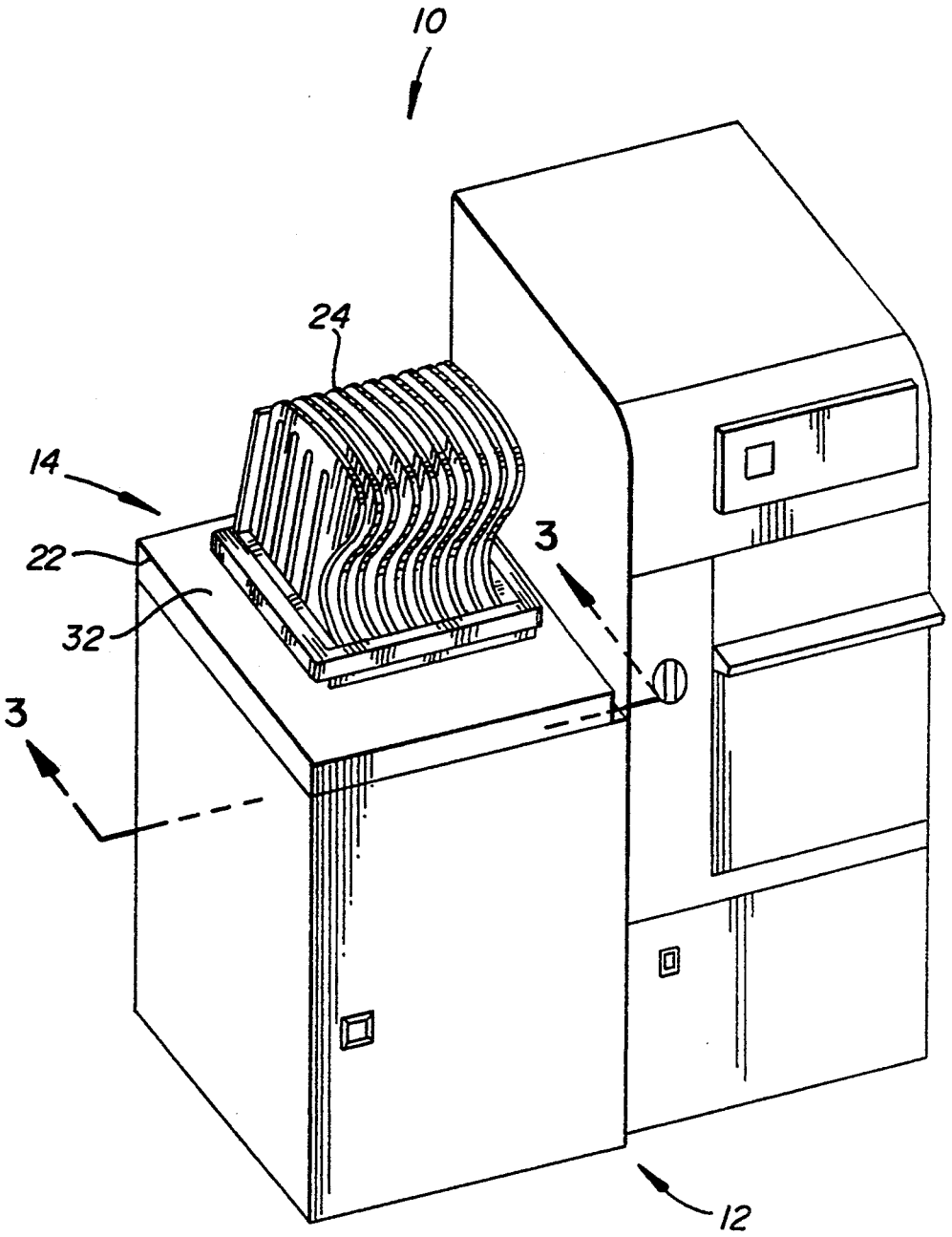
FIG. 1 is a perspective view of the sorting and processing apparatus of the invention, which includes the sorting apparatus of the invention.
Figure 2:
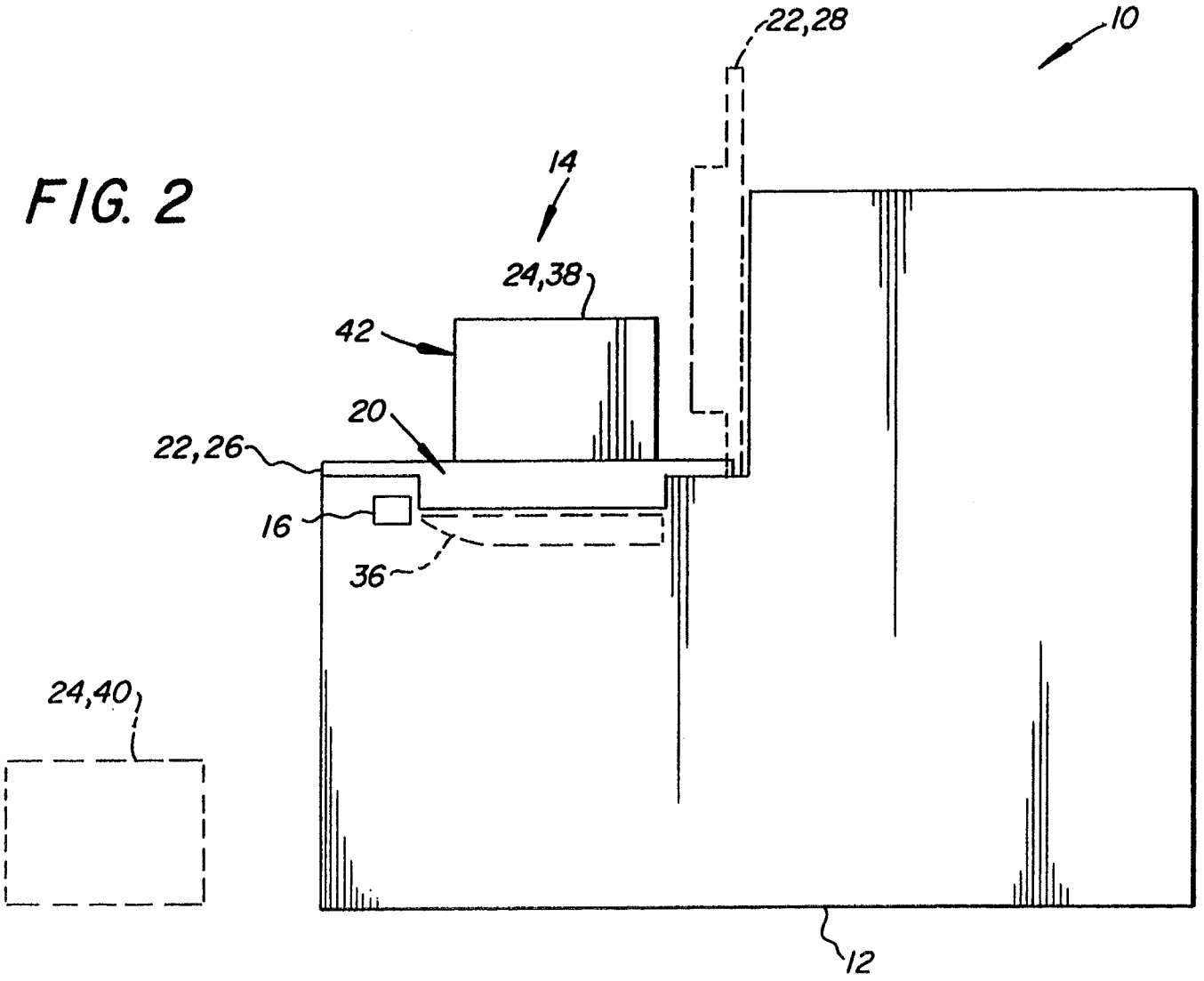
FIG. 2 is a side plan view of the sorting and processing apparatus of FIG. 1. The body of the sorting apparatus is shown in solid lines in a closed position and in dashed lines in an open position. The partition member of the sorting apparatus is shown in an operative position in solid lines and in a displaced position in dashed lines.
Figure 3:
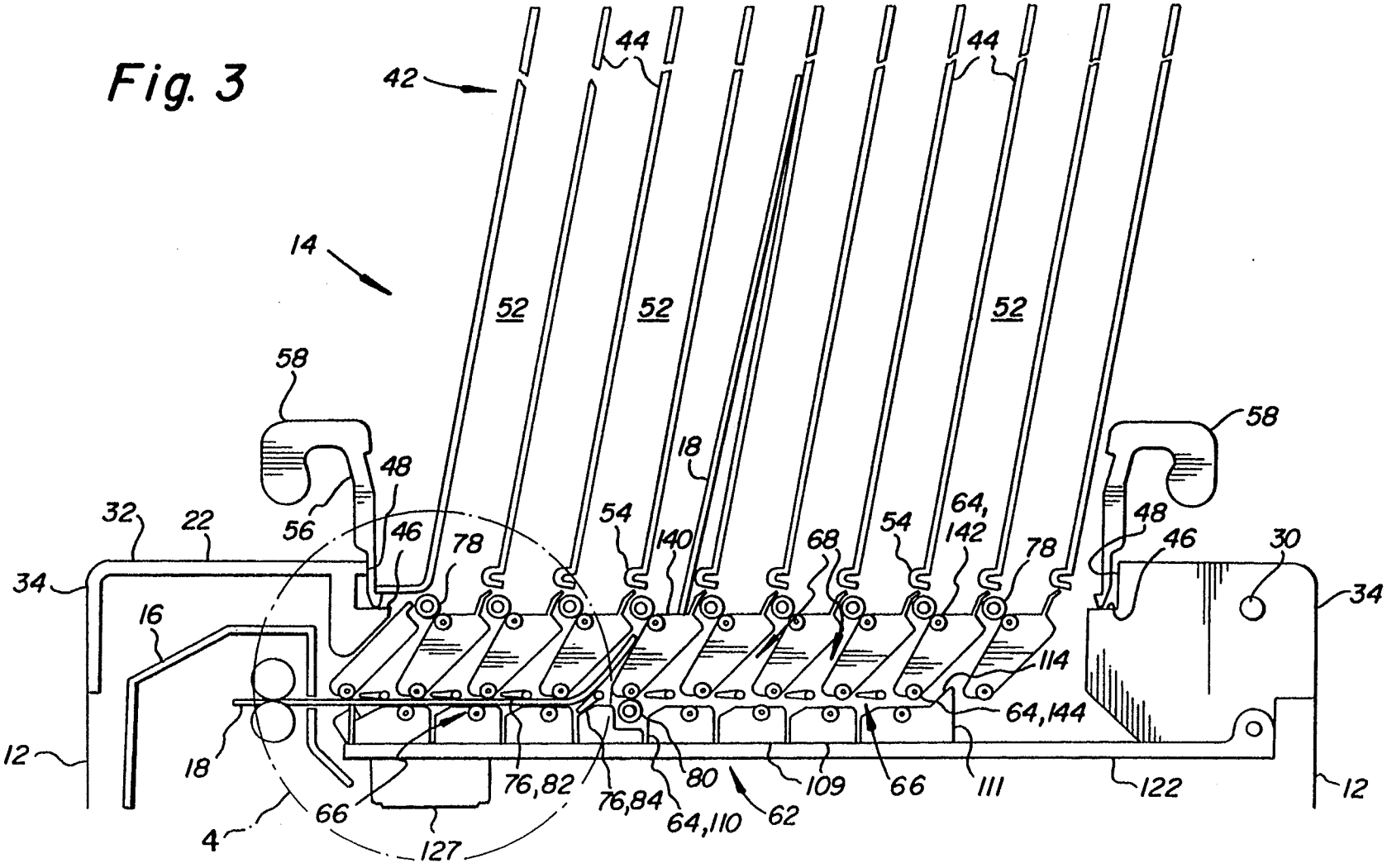
FIG. 3 is a cross-sectional view of the sorting apparatus and a portion of the processor of FIG. 1 taken substantially along line 3—3 in FIG. 1.

Referring initially to FIGS. 1 and 2, the sorting and processing apparatus 10 of the invention includes a processor 12 and the sorting apparatus 14 of the invention. The processor 12 is a conventional media sheet processor, such as an electrophotographic copier or an X-ray film processor. In one preferred embodiment of the invention, processor 12 is an X-ray film processor, such as a Kodak X-OMAT 180LP Processor, docked to a laser printer, such as a Kodak Ektascan 2180 Laser Printer. Referring now to FIGS. 1–3, in preferred embodiments of the invention, processor 12 has a top discharge 16 that delivers processed media sheets 18 and a service opening 20 adjoining the discharge 16.

The sorting apparatus 14 has a body 22 and a partition member 24. The body 22 is mounted for use on the processor 12 and receives media sheets 18 from the discharge 16 of the processor 12. The body 22 is movable between a closed position 26, shown in solid lines in FIG. 2, and an open position 28, shown in dashed lines in FIG. 2. In the closed position 26, the body 22 is disposed on the processor 12 and acts as a door over the service opening 20 of the processor 12. In the open position 28, the body 22 is displaced from the processor 12 and clear of the service opening 20. Access is then available to the discharge 16 and other parts of the processor 12. It is preferred that, the body 22 is mounted to the processor 12 so as to move quickly and easily from closed position 26 to open position 28. This allows, for example, quick access to the discharge 16 for an emergency x-ray film, if the sorting apparatus 14 jams or is overfilled. It is currently preferred that the body 22 be hinged to the processor 12 and pivot, about an axis of rotation 30, (shown in FIG. 3) between open and closed positions 28,26. It is further preferred that the body 22 have an upper surface 32 that is substantially radial to the axis of rotation 30.

The body 22 includes a carcass 34 made of folded sheet metal, or sheet metal and bar stock, or reinforced plastic or the like. The carcass 34 holds other components in position and is configured so as to meet the requirements of a particular use.

Sorting apparatus 14 can optionally include, in addition to body 22 and partition member 24, a default tray 36 (indicated by dashed lines in FIG. 2) mounted in processor 12 so as to receive media sheets delivered by the discharge 16 when the sorting apparatus body 22 is in the open position 28. Default tray 36 can be suspended in processor 12 and can lift out for processor servicing. The conformation of default tray 36 can be varied to meet the needs of a particular use; however, default tray 36 should be positioned and shaped so as to not interfere with the body 22 when body 22 is in closed position 26.

The partition member 24 is mounted on the body 22 and is movable, independent of the body 22, between an operative position 38, shown in solid lines in FIG. 2, and a displaced position 40, shown in dashed lines in FIG. 2. In the operative position 38, the partition member 24 is in operative relation to the body 22 and occupies a particular area of space relative to the body 22, which is referred to herein as a "zone of obstruction 42". The zone of obstruction 42 identifies how close another object can approach the upper surface 32 of the body 22, absent the removal of partitions 44. In the displaced position 40, the partitions 44 are completely, or at least substantially removed from the zone of obstruction 42. This permits use of the sorting apparatus 14 of the invention in applications where space is limited. For example, the processor 12 shown in FIG. 2 has a tall portion which would severely hinder pivoting of a sorting apparatus 14 bearing a fixed partition member. In a currently preferred embodiment of the invention, the partition member 24 is a unitary assembly which, in the displaced position 40, is lifted from the body 22 and placed on the floor or some other convenient support.

Figure 4:
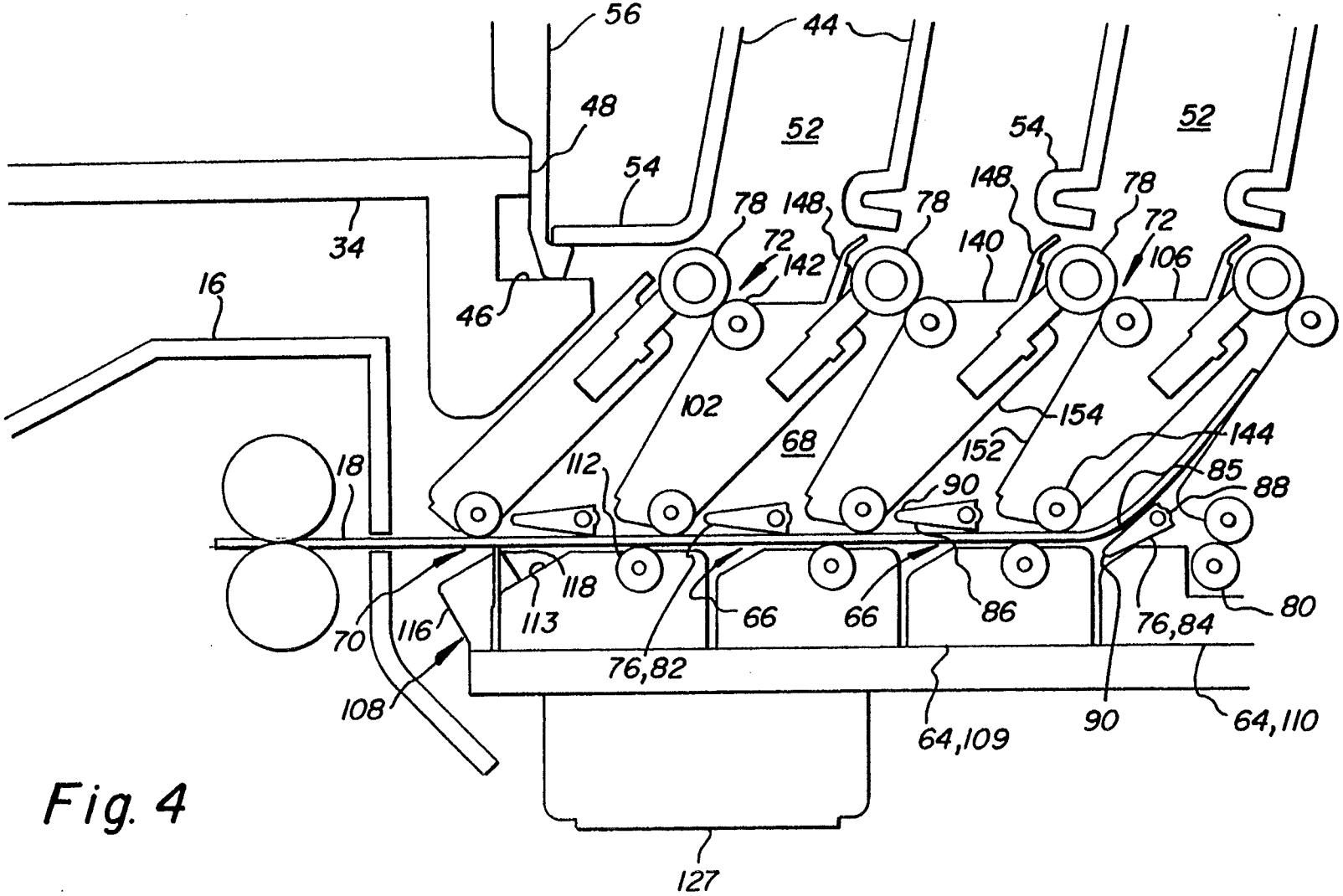
FIG. 4 is enlarged cross-sectional view of the sorting apparatus of FIG. 2 showing the portion indicated by circle 4 in FIG. 3.
Figure 5:
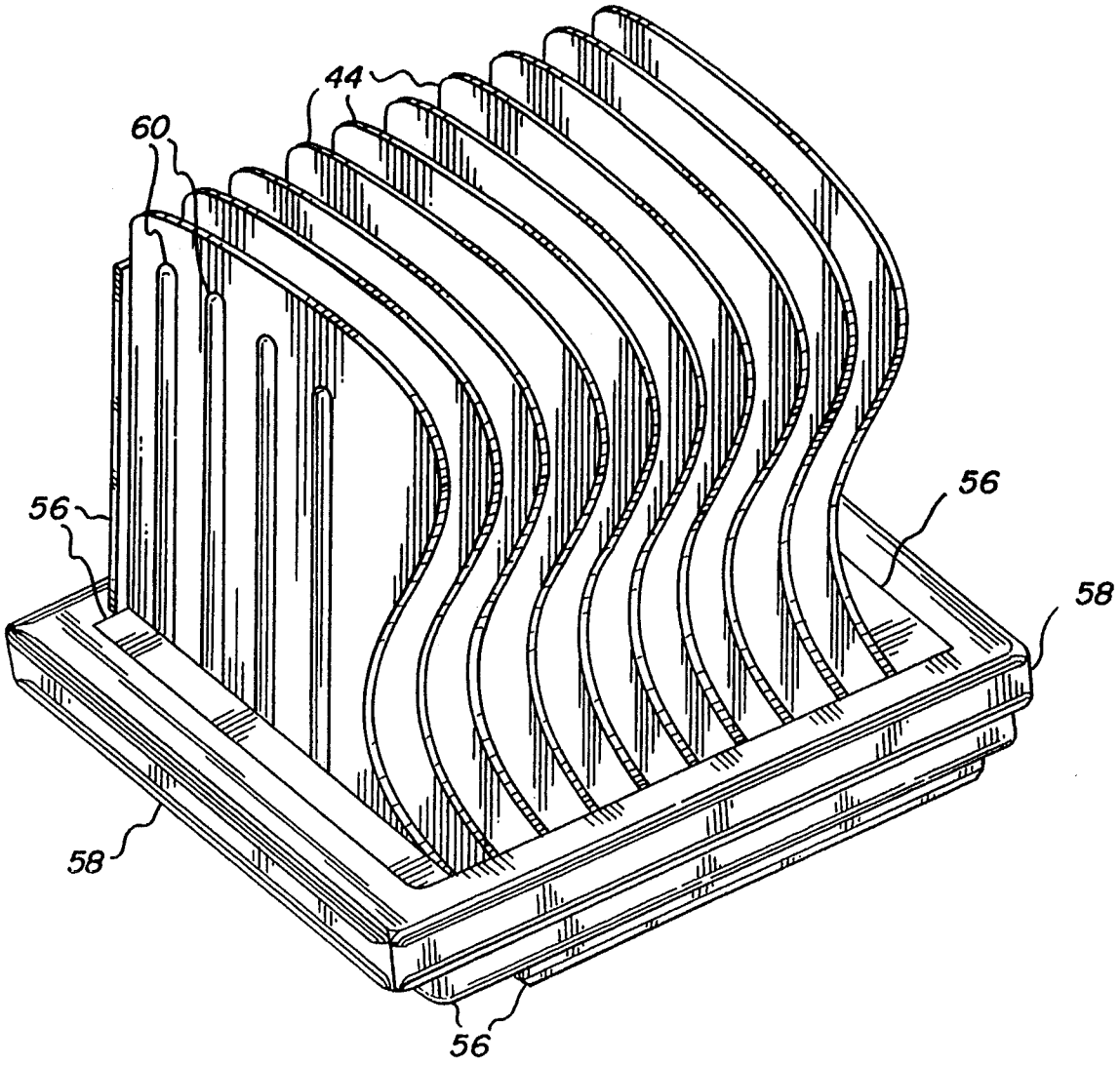
FIG. 5 is a perspective view of the partition member of the sorting apparatus of FIG. 1.

Referring now to FIGS. 3–4, in a preferred embodiment of the invention, the partition member 24, in the operative position 38, rests on a seat 46 formed in the upper surface 32 of body 22. In that embodiment, lateral movement of partition member 24 is limited by stops 48, but partition member 24 is freely movable in a vertical direction. Partition member 24 can be held in place by catches (not shown); however, it is highly preferred that removal of partition member 24 from body 22 not be subjected to any delay for reason of catches.

Referring now principally to FIGS. 1, 3–4, and 5, the partition member 24 comprises a unitary array of parallel partitions 44 that extend outward from the body 22, when the partition member 24 is in the operative position 38. If desired, partitions can be configured to support sorted media sheets during movement of partition member; however, this is undesirable in any use in which the sorted sheets carry considerable weight. In a preferred embodiment of the invention, the partitions 44 have no bottom surface and the partitions 44 in combination with the body 22 form a series of bins 52 into which media sheets 18 are distributed. In that embodiment of the invention, the partition member 24 is easily and quickly removed from operative position 38, even when bins 52 are filled with a heavy load of x-ray films. It is envisioned that ordinarily the films would be quickly removed before removal of the partition member 24. In an emergency, however, the partition member 24 could be removed first, allowing immediate access to the processor discharge 16. In that embodiment of the invention, partitions 44 have a media protector or guard 54 lowermost. Media guards 54 are discussed below in greater detail.

Partitions 44 are held in place by a frame 56. Partition member 24 can have an integral handle 58. In a preferred embodiment of the invention, the handle 58 extends continuously around all four sides of partition member 24 and is itself continuous with frame 56. The handle 58, in that embodiment of the invention adds strength and rigidity to partition member 24 and in addition allows partition member 24 to be easily gripped by a person standing anywhere within reach of partition member 24. This reduces the time needed to remove partition member 24.

It is desirable that the partition member 24 be light in weight but strong enough to withstand a reasonable measure of rough treatment. A variety of materials suitable for use in the partition member 24, such as high impact plastics, are available and well known to those skilled in the art. Stiffening welts 60 and the like can also be used to further reduce weight. In a preferred embodiment of the invention, handle 58 is hollow to reduce weight.

Referring now particularly to FIGS. 3 and 4, a sorter mechanism 62 is disposed substantially within the body 22 of sorting apparatus 14. The sorter mechanism 62 has sheet guides 64 which define a primary passage 66 and a series of secondary passages 68 individually branching from the primary passage 66. Particular sheet guides 64 are discussed below in greater detail. In addition to the guides 64 that are discussed, other guides can be provided as needed to assure unhindered movement of media sheet through the sorting apparatus 14. The primary passage 66 has an entrance 70 aligned with the discharge 16 of the processor 12. The secondary passages 68 each have an exit 72 that adjoins one of the bins 52.

The sorter mechanism 62 has a transport system that, in cooperation with the sheet guides 64, propels the media sheets 18 into the bins 52. The transport system provides enough motive force to move the media sheets 18 through the primary passage 66 and selected secondary passages 68 and includes deflectors 76, to allow sorting by a variety of selection criteria. Sheet guides 64 reduce friction and direct media sheets 18 as needed to allow easy movement of the media sheets 18 through the passages 66,68. Detailed features of the transport system and sheet guides 64 depend upon particular uses.

In particular embodiments of the invention, discharge 16 is powered and propels media sheets 18 into primary passage 66. An upper drive 78 in each secondary passage 68 propels media sheets 18 out into bins 52. Depending upon the number of bins 52, the capabilities of discharge 16, and the relative lengths of media sheets 18 and primary passage 66; one or more lower drives 80 may also be provided in primary passage 66.

Referring now to FIGS. 3 and 4, each deflector 76 adjoins the primary passage 66 and an individual secondary passage 68 and is movable between a bypass position 82 and a deflection position 84. In the bypass position 82, the deflector 76 borders the primary passage 66 and blocks the adjoining secondary passage 68. In the deflection position 84, the deflector 76 blocks the primary passage 66 and borders the adjoining secondary passage 68. When the deflector 76 is in the bypass position 82, the deflector 76 directs the media sheet 18 along the primary passage 66 past the blocked secondary passage 68. When the deflector 76 is in the deflection position 84, the deflector 76 directs the media sheet 18 from the blocked primary passage 66 into the selected secondary passage 68. In a particular embodiment of the invention, the deflectors 76 are shaped like laterally elongated paddles, with opposed flattened faces 85,86. Each deflector 76 is pivoted about an axis at the deflector's wider end 88. In the bypass position 82, one face 86 of a deflector 76 is aligned with the primary passage 66. In the deflection position 84, the opposite face 85 forms a ramp from the primary passage 66 into the associated secondary passage 68. In a preferred embodiment of the invention, the upstream end 90 of each deflector 76 is outside of primary passage 66 in both the bypass position 82 and the deflection position 84. This reduces the possibility of media jams, since the leading edge of the media sheet 18 is unlikely to erroneously engage the upstream end 90 of deflector 76.

The deflectors 76 are individually and selectively movable between bypass and deflection positions 82,84. Motive force for the movement may be provided by any of a variety of actuators 92 (indicated diagrammatically in FIG. 6) well known to those skilled in the art. For example, individual deflectors 76 could each be directly or indirectly connected to an individual stepper motor or solenoid.

Figure 6:
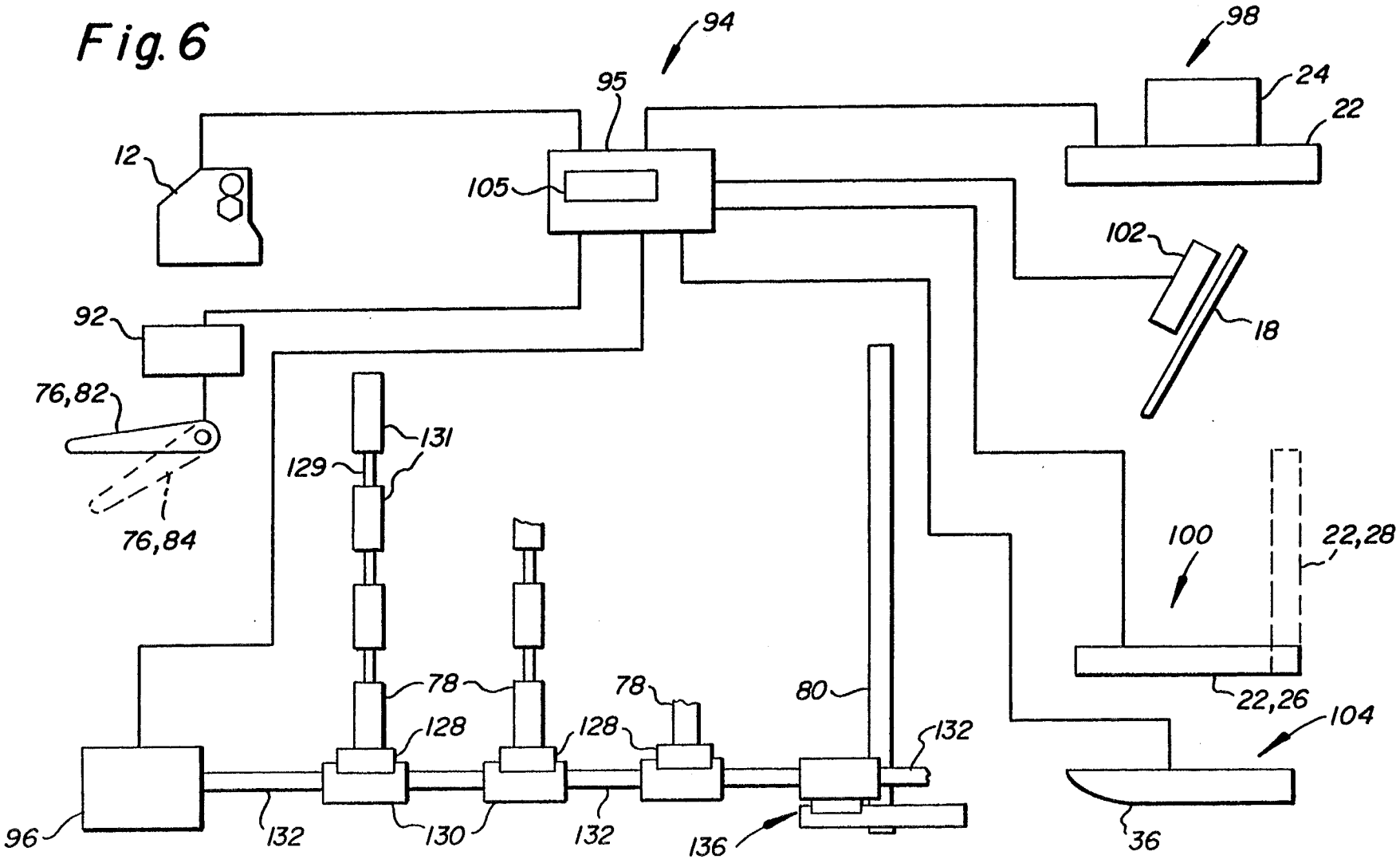
FIG. 6 is diagrammatical view of the control system and controlled components of the sorting apparatus of FIG. 1.

Actuators 92 are controlled by a control system 94 (indicated diagrammatically in FIG. 6). Suitable control systems 94 can take a wide variety of forms and can be, for example, mechanical, mechanical-electrical, or can be analog or digital electronic. For reasons of cost and flexibility of use, digital electronic control systems using microprocessors are preferred. Suitable systems are well known to those skilled in the art. In a particular embodiment of the invention, shown diagrammatically in FIG. 6, a microprocessor control system 94 uses, for example, a Model MC 68 HC 11 microprocessor from Motorola, Inc. of Austin, Tex. as a controller 95. In addition to controlling the positions of the deflectors 76, the controller 95 receives a synchronization signal from the processor 12, which is used to synchronize a motor 96 that powers the upper and lower drives 78,80. The control system 94 can also monitor switches or the like. Examples of such elements are symbolized in FIG. 6 by elements 98, 100, and 104 and by sensor 102. Switch 98 signals if partition member 24 is in operative position 38. Switch 100 signals if body 22 is in open or closed position 28,26. Sensor 102 signals when a media sheet 18 is detected. Switch 104 signals if default tray is in position.

The signals to control system 94 from sensors 102 monitor the presence of media sheets 18 in secondary passages 68. The sensors 102 can track both current sorting status and the occurrence of any jam in the secondary passages 68. If desired, the control system 94 can include a liquid crystal display or other display 105 which can present information to the user, such as the size of films 18 sorted to each bin 52 and the occurrence of jams. Suitable components for the control system 94 are well known to those skilled in the art. Sensors 102 are preferably electro-optical or other non-mechanical type; however, mechanical sensors, such as those based upon a follower mechanism, could also be used.

The primary and secondary passages 66,68 can be formed by discrete dividers positioned within body 22; however, in a preferred embodiment of the invention, primary and secondary passages 66,68 are formed by a series of interchangeable guide modules 106. In that embodiment of the invention, the guide modules 106 are disposed between the upper drives 78 and a bottom guide assembly 108.

The bottom guide assembly 108 is disposed at the bottom of body 22 and includes three types of bottom guide units 109,110,111. Each bottom guide unit 109,110,111 provides an offset from the bottom of body 22. First bottom guide units 109 have a low friction upper end 112, which can include one or more rollers or other friction reducing structures. An upstream corner 113 of each first bottom guide 109 is chamfered to provide clearance for a respective deflector 76 in deflection position 84. The remainder of first bottom guide 109 is shaped as convenient. A second bottom guide 110 differs from first bottom guide 109 only in having a recess to accommodate the lower drive 80. A third bottom guide 111 resembles first bottom guide 109 except that the upper surface includes a final ramp portion 114 which takes the place of a deflector 76 in the deflection position. Third bottom guide 111 is mounted farthest downstream of the bottom guides 109,110,111 and sheets 18 are directed by final ramp portion 114 into the last bin 52. In this embodiment of the invention, primary passage 66 ends at third bottom guide 111. Primary passage 66 could alternatively extend onward in some manner, in which case, third bottom guide 111 would be deleted in favor of a first bottom guide 109 and a deflector 76.

In a particular embodiment of the invention, bottom guide assembly 108 also includes an entry bottom guide unit 116 which is shaped so as encourage media sheets 18 toward primary passage 66. Entry bottom guide unit 116 can include a conductive brush or the like to help control static charge on the media sheets 18.

Figure 7:
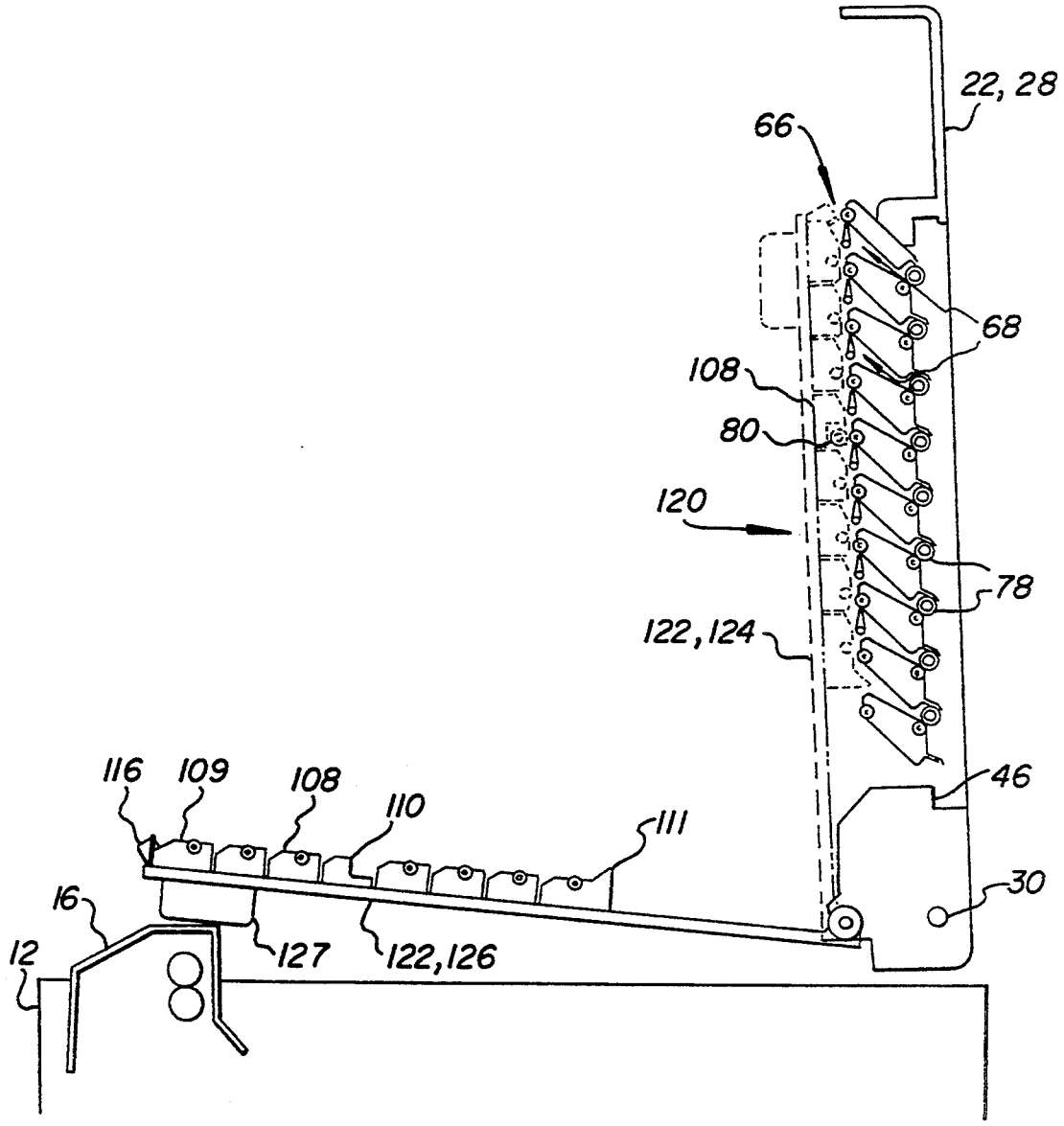
FIG. 7 is a side plan view of the body of the sorting apparatus of FIG. 1, with the body in open position. The hatch of the body is shown in a first position in dashed lines and in a second position in solid lines.

Referring now to FIGS. 3 and 7, it is preferred that the lower surface of body 22 include an access opening 120. Access opening 120 communicates directly with and provides access to primary passage 66. A hatch 122 is mounted to lower surface of body 22. The hatch 122 is movable between a first position 124 (indicated by dashed lines in FIG. 7), in which the hatch 122 occupies the access opening 120 and protects the interior of body 22, and a second position 126 (indicated by solid lines in FIG. 7) in which the hatch 122 is displaced from the access opening 120. Hatch 122 allows quick access to primary passage 66 in case of a media sheet jam. If a jam occurs, partition member 24 can be displaced from body 22, body 22 can then be pivoted to the open position 28, and the hatch 122 can then be opened. In a particular embodiment of the invention, bottom guide assembly 108 is mounted to hatch 122 and moves with hatch 122. Lower drive 80 may or may not also be part of hatch 122 and move with hatch 122. In this embodiment, complete or nearly complete access to primary passage 66 is provided and it is very easy to remove jammed sheets of even relatively stiff media like x-ray films. Hatch 122 can alternatively incorporate none or only a portion of a bottom sheet guide assembly 108. For convenience, hatch 122 can include a handgrip 127.

Referring now to FIGS. 3 and 6, the upper drives 78 comprise an array of driven rollers disposed along the body 22 slightly below upper surface 32. In a particular embodiment of the invention, upper drives 78 each have an axle 129 that extends the width of body 22. Axle 129 is fitted with a series of pucks 131 separated by gaps. Each axle 129 and its pucks 131 is positively driven by a pinion 128 at one end. Pinions 128 are mated to worm gears 130 borne by a driveshaft 132, which is driven by motor or other power source 96. Driveshaft 132 can also operate a gear train 136 meshed to lower drive 80. Upper drives 78 could also be driven by belts or other means. Upper drives 78 could also be a continuous roller or a series of separated rollers driven in synchrony by mechanical or electronic means. Lower drive can be varied in the same manner.

Figure 8:
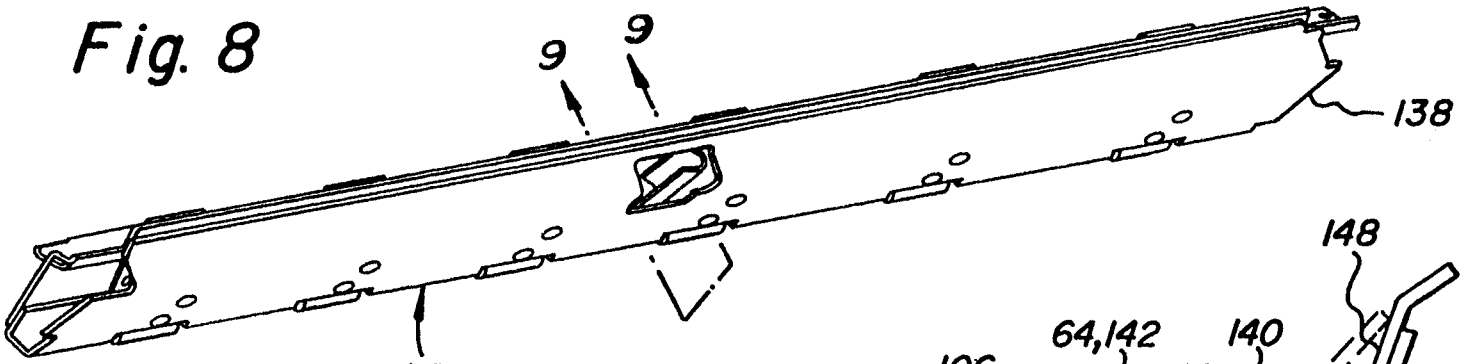
FIG. 8 is a perspective view of a guide module of the sorting apparatus of FIG. 1.
Figure 9:
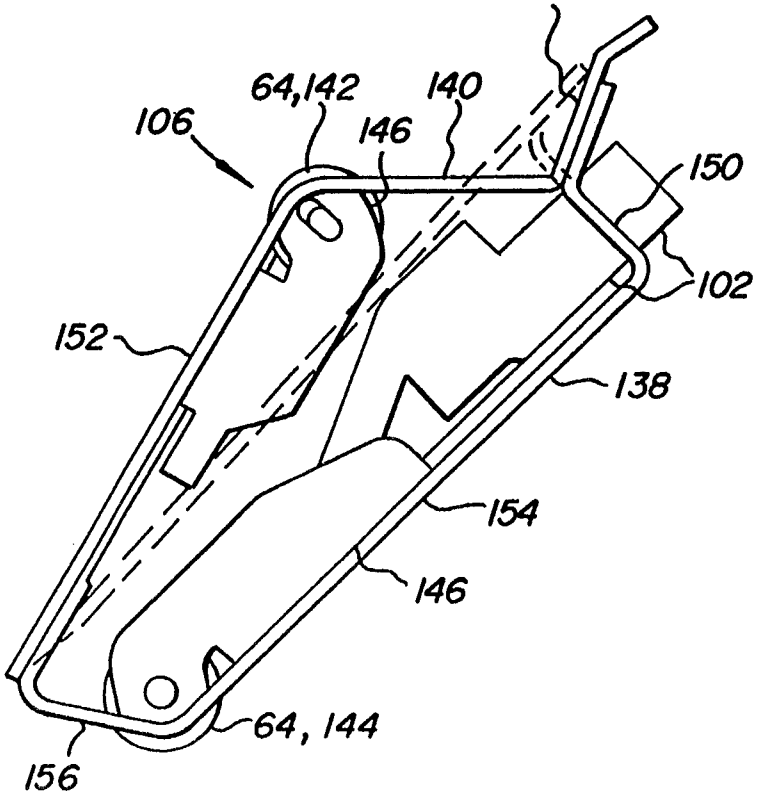
FIG. 9 is a cross-sectional view of the guide module of FIG. 8 taken substantially along line 9—9 in FIG. 8.

Referring now to FIGS. 3, 8 and 9, guide modules 106 are disposed within body 22 between upper drives 78 and bottom guide assembly 108. Guide modules 106 extend the width of the body 22. Each guide module 106 includes a shell 138 formed of sheet metal or other material having similar characteristics, folded or otherwise formed into an elongated tube, having the cross-sectional shape of a distorted lozenge or wedge.

Each shell 138 has a sheet support 140 which is substantially planar and acts as the lower boundary of a respective bin 52. The sheet support 140 is disposed at an oblique angle to a respective secondary passage 68. Each sheet support 140 receives and supports media sheets 18 received within the bin 52.

Upstream (toward the discharge 16) from the sheet support 140 is an upper guide 142, which extends slightly above the sheet support 140. Upper guides 142 (and lower guides 144 discussed below) are described herein as if they had the form of a single structure extending completely across the width of body 22. It should be understood that this is a matter of convenience. The discussion here applies equally to guides that are continuous and guides that are divided into separate segments, as shown in FIG. 8.

The upper guide 142 is disposed in operative relation to a respective upper drive 78. Upper guides 142, like other guides herein, can be non-movable; it is preferred, however, that upper guides 142 be idler rollers resiliently biased toward a respective upper drive 78. Biasing can be provided by a spring (not shown) in a guide block 146 acting on an upper guide axle retained in slots in the guide block 146. The upper guide 142 rotates within the guide block 146, bears upon the adjoining upper drive 78, and is driven by that upper drive 78. The guide block 146 and most of the upper guide 142 are disposed within the shell 138. The resiliently biased upper guides 142 minimize friction and allow slippage of media sheets 18 in case of intermittent binding or non-uniform driving. The direction of rotation of upper guide 142 urges a sorted media sheet 18 onto sheet support 140.

Downstream from the sheet support 140 is a media guard 148, in the shape of a raised lip, that extends upward and downstream relative to sheet support 140. The module media guard 148 adjoins the media guard 54 of the adjoining partition 44. Both of these media guards 148,54 act together to prevent sorted media sheets 18 from contacting the downstream upper drive 78 (the upper drive 78 which drives the upper guide 142 of the succeeding guide module 106) and thus prevent the undesirable abrasion that would otherwise occur. Media guards 148,54 also prevent a media sheet 18 from contacting an upper drive 78 when the sheet is removed by the operator and then returned to a bin 52.

Downstream from media guard 148 is a downwardly directed trailing surface 150. The media guard 148 and trailing surface 150 of a guide module 106 enfold the downstream upper drive 78. In a particular embodiment of the invention, a sensor 102 extends through a gap in trailing surface 150 and direct a light beam or the like at secondary passage 68 near exit 72. Sensor 102 in that embodiment, is disposed between pucks 131 of upper drive 78.

Extending downward and upstream from the trailing surface 150 is an first surface 152. Extending downward and upstream from the sheet support 140 and upper guide 142 is a second surface 154. First and second surfaces 152,154 are angled toward each other. Opposite sheet support 140, a lower surface 156 joins first and second surfaces 152,154. Lower surface 156 can be parallel to sheet support 140, but it is preferred that lower surface 156 be angled downward in an downstream direction.

Diagonally opposite upper guide 142, at the meeting of second surface 154 and lower surface 156 is a lower guide 144. Lower guides 144 are held by a guide block 146 and may or may not be biased toward primary passage 66. In a preferred embodiment of the invention, lower guides 144, with one exception, are free to rotate, but fixed relative to primary passage 66 rather than being movable and resiliently biased. The exception is the lower guide adjoining the lower drive 80, which is resiliently biased toward the lower drive 80. Each lower guide 144 is positioned to contact and reduce frictional hindrance of a media sheet 18 traveling along primary passage 66 or into a respective secondary passage 68.

In a particular embodiment of the invention, the most upstream guide module is modified to avoid clearance problems by eliminating upper guide 142, eliminating or reducing sheet support 140 (both of which are unused in this guide module), and moving first surface 152 back toward second surface 154, as indicated by the dashed line in FIG. 9. In that embodiment of the invention, the adjoining partition 44 is also modified, as shown in FIG. 3, and the media guard 54 is extended and fixed to the frame 56 of partition mender 24.

The guide modules 106 in combination with bottom guide assembly 108 delimit the primary passage 66 and secondary passages 68. The primary passage 66 is bordered on the bottom by the bottom guide assembly 108 and on the top by the lower guides 144 of the guide modules 106. Secondary passages 68 are bordered by inwardly sloped first and second surfaces 152,154 of adjoining guide modules 106. The exit 72 of each secondary passage 68 is the nip between an upper drive 78 and upper guide 142.

In routine use of an embodiment of the invention that includes guide modules, a media sheet 18 is delivered by discharge 16 into the entrance 70 of primary passage 66. Deflectors 76 are positioned as determined by the control system 94 and direct the media sheet 18 into a selected secondary passage 68. Depending upon the distance of travel of the media sheet 18 along primary passage 18, the media sheet 18 may also be driven by lower drive 80. The media sheet 18 passes through the selected secondary passage 68, trips the sensor 102 and is driven by the upper drive 78 in combination with upper guide 142 through exit 72 and into the bin 52. Within bin 52, the media sheet 18 rests upon a sheet support 140.

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto.

What is claimed is:

1. A sorting apparatus for use with a processor for media sheets, said processor delivering said media sheets from a discharge, said sorting apparatus comprising:

a body, a bottom guide assembly disposed within said body, a plurality of upper drives disposed along said body in spaced relation to said bottom guide assembly, a plurality of guide modules disposed within said body, each said guide module having an upper guide disposed in operative relation to a respective said upper drive, each said guide module having a lower guide disposed in spaced relation to said bottom guide assembly, said guide modules and said bottom guide assembly together defining a primary passage and a plurality of secondary passages, said primary passage having an entrance aligned with said discharge, said secondary passages each branching individually from said primary passage, said secondary passages each having an exit adjoining a respective said upper drive and respective said upper guide;

a plurality of deflectors disposed within said body above said bottom guide assembly, each said deflector adjoining said primary passage and a respective said secondary passage, each said deflector being individually and selectably movable between a bypass position, wherein said deflector borders said primary passage and blocks said adjoining secondary passage, and a deflection position, wherein said deflector blocks said primary passage and borders said adjoining secondary passage.

2. The sorting apparatus of claim 1 wherein said upper drives are positively driven.

3. The sorting apparatus of claim 2 further comprising a lower drive disposed in operative relation to said primary passage.

4. The sorting apparatus of claim 1 wherein said body is pivotable about an axis of rotation, and said body includes means for mounting on said processer wherein said body is pivotable between a closed position limiting access to said processer and an open position displaced from said processer.

5. The sorting apparatus of claim 4 further comprising a partition member mounted on said body, said partition member comprising a unitary array of parallel partitions extending outward from said body, said partitions defining a first plurality of bins for said media sheets, said bins each communicating with a respective said secondary passage exit, said partition member being movable, independent of said body, between an operative position, wherein said partitions define a zone of obstruction extending outward from said body, and a displaced position, wherein said partitions are at least substantially removed from said zone.

6. The sorting apparatus of claim 5 wherein each said guide module has a sheet support adjoining said upper guide of said guide module, each said sheet support being disposed under a respective said bin to support media sheets received within said bin.

7. The sorting apparatus of claim 6 wherein said partitions and said sheet supports each include a media guard disposed to protect said media sheets from an adjoining said upper drive.

8. The sorting apparatus of claim 1 wherein said upper guides further comprise rollers resiliently biased toward a respective said upper drive.

9. The sorting apparatus of claim 1 wherein said body has an access opening adjoining said primary passage, and further comprising a hatch movable between a first position wherein said hatch occupies said access opening and a second position wherein said hatch is displaced from said access opening.

10. The sorting apparatus of claim 1 wherein each said guide module has a sheet support adjoining said upper guide of said guide module, said sheet support being disposed at an oblique angle to a respective said secondary passage.

11. The sorting apparatus of claim 1 wherein each said guide module has a sheet sensor disposed to detect passage of a media sheet through a respective secondary passage.

12. A sorting and processing apparatus for use with media sheets, said sorting and processing apparatus comprising:

a processing portion having a top discharge and a service opening adjoining said discharge; and a sorting portion comprising:

a body mounted on said processing portion, said body being pivotable about an axis of rotation, between a closed position and an open position, said body in said closed position blocking access to said service opening, said body in said open position being displaced from said service opening;

a partition member mounted on said body, said partition member comprising a unitary array of parallel partitions extending outward from said body and a handle adjoining said partitions, said partitions defining a first plurality of bins for said media sheets, said partition member being movable, independent of said body, between an operative position, wherein said partitions define a zone of obstruction extending outward from said upper surface of said body, and a displaced position, wherein said partitions are at least substantially removed from said zone;

a sorter mechanism disposed substantially within said body, said sorter mechanism further comprising a bottom guide assembly disposed within said body, a plurality of upper drives disposed along said body in spaced relation to said bottom guide assembly, a plurality of guide modules disposed within said body, each said guide module having an upper guide disposed in operative relation to a respective said upper drive, each said guide module having a lower guide disposed in spaced relation to said bottom guide assembly, said guide modules and said bottom guide assembly together defining a primary passage and a plurality of secondary passages, said primary passage having an entrance aligned with said discharge, said secondary passages each branching individually from said primary passage, said secondary passages each having an exit adjoining a respective said upper drive and respective said upper guide, each said guide module having a sheet support adjoining said upper guide of said guide module; and a plurality of deflectors disposed within said body above said bottom guide assembly, each said deflector adjoining said primary passage and a respective said secondary passage, each said deflector being individually and selectably movable between a bypass position, wherein said deflector borders said primary passage and blocks said adjoining secondary passage, and a deflection position, wherein said deflector blocks said primary passage and borders said adjoining secondary passage;

said body having an access opening adjoining said primary passage, and a hatch movable between a first position wherein said hatch occupies said access opening and a second position wherein said hatch is displaced from said access opening.

13. A sorting apparatus for use with a processer discharging processed media sheets, said sorting apparatus comprising:

a body pivotable about an axis of rotation, between a closed position and an open position, said body having an upper surface substantially radial to said axis of rotation;

a partition member mounted on said body, said partition member comprising an array of partitions extending outward from said body, said partitions defining a plurality of bins for said media sheets, said partition member being movable, independent of said body, between an operative position, wherein said partitions define a zone of obstruction extending outward from said upper surface of said body, and a displaced position, wherein said partitions are at least substantially removed from said zone;

a sorter mechanism disposed substantially within said body, said sorter mechanism including a transport system for propelling said processed media sheets to selected said bins; and a default bin disposed to receive said media sheets only when said body is in said open position.

14. A sorting apparatus for use with a processer for media sheets, said sorting apparatus comprising:

a body mountable on said processer;

a partition member mounted on said body, said partition member comprising a unitary array of parallel partitions extending outward from said body, said partitions defining a first plurality of bins for said media sheets, said partition member being movable, independent of said body, between an operative position, wherein said partitions define a zone of obstruction extending outward from said body, and a displaced position, wherein said partitions are at least substantially removed from said zone, said partition member having a continuous handle adjoining said partitions on four sides;

a sorter mechanism for sorting said media sheets into selected said bins, said sorter mechanism being disposed substantially within said body.

15. The sorting apparatus of claim 14 wherein said body is pivotable about an axis of rotation and said body has an upper surface substantially radial to said axis of rotation.

16. A sorting apparatus for use with a processer for media sheets, said sorting apparatus comprising:

a body mountable on said processer;

a partition member mounted on said body, said partition member comprising an array of partitions extending outward from said body, said partitions defining a plurality of bins for said media sheets, said partition member being movable, independent of said body, between an operative position, wherein said partitions define a zone of obstruction extending outward from said body, and a displaced position, wherein said partitions are at least substantially removed from said zone; and a sorter mechanism for sorting said media sheets into selected said bins;

said body having a plurality of sheet supports, each said sheet support being disposed under a respective said bin to support media sheets received within said bin.

17. The sorting apparatus of claim 16 wherein said body is pivotable about an axis of rotation, said body has an upper surface substantially radial to said axis of rotation, and said sorter mechanism includes a transport system for propelling said processed media sheets to selected said bins.

18. The sorting apparatus of claim 17 wherein said partitions and said sheet supports each include a media guard disposed to protect said media sheets from post-sorting contact with said transport system.

* * * * *